US008408194B2

(12) United States Patent
Andresen

(10) Patent No.: US 8,408,194 B2
(45) **Date of Patent: *Apr. 2, 2013**

(54) PROCEDURE AND DEVICE FOR FEEDING BALLS INTO THE PROJECTILE CHAMBER OF A HANDGUN

(75) Inventor: Heddies Andresen, Quickborn (DE)

(73) Assignee: KEE Action Sports I LLC, Sewell, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/853,023

(22) Filed: Aug. 9, 2010

(65) Prior Publication Data

US 2011/0023858 A1 Feb. 3, 2011

Related U.S. Application Data

(63) Continuation of application No. 11/841,096, filed on Aug. 20, 2007, now Pat. No. 7,770,569, which is a continuation of application No. 11/182,937, filed on Jul. 15, 2005, now abandoned, which is a continuation-in-part of application No. 10/965,384, filed on Oct. 14, 2004, now Pat. No. 7,428,899.

(51) Int. Cl.
*F41B 11/02* (2006.01)

(52) U.S. Cl. ..... 124/51.1

(58) Field of Classification Search ..... 124/48, 124/49, 51.1, 73, 74

See application file for complete search history.

(56) References Cited

U.S. PATENT DOCUMENTS

| | | | |
|---|---|---|---|
| 5,755,056 | A | 5/1998 | Danner et al. |
| 5,791,325 | A | 8/1998 | Anderson |
| 5,816,232 | A | 10/1998 | Bell |
| 5,954,042 | A | 9/1999 | Harvey |
| 6,109,252 | A | 8/2000 | Stevens |
| 6,213,110 | B1 | 4/2001 | Christopher et al. |
| 6,327,953 | B1 | 12/2001 | Andresen |
| 6,415,781 | B1 | 7/2002 | Perrone |
| 6,467,473 | B1 | 10/2002 | Kostiopoulos |
| 6,488,019 | B2 | 12/2002 | Kotsiopoulos |
| 6,701,907 | B2 | 3/2004 | Christopher et al. |
| 6,739,323 | B2 | 5/2004 | Tippmann, Jr. |
| 6,792,933 | B2 | 9/2004 | Christopher et al. |
| 6,889,680 | B2 | 5/2005 | Christopher et al. |
| 6,915,792 | B1 | 7/2005 | Sheng |
| 6,978,776 | B2 | 12/2005 | Hamilton |

(Continued)

FOREIGN PATENT DOCUMENTS

| | | |
|---|---|---|
| DE | 876370 | 5/1953 |
| DE | 2035097 | 8/1982 |

(Continued)

OTHER PUBLICATIONS

WARPIG—World and Regional Paintball Information Guide, http://www.warpig.com/paintball/technical/loaders/evlution/evlution... eVLution 2 Sneak Preview, by Bill Mills, Aug. 2001, p. 1 to 4.

(Continued)

*Primary Examiner* — John Ricci

(74) *Attorney, Agent, or Firm* — Volpe and Koenig, P.C.

(57) ABSTRACT

A device for storing projectile balls and feeding the balls into a projectile chamber of a gun is provided. A ball container includes a feeder positioned within the ball container for feeding balls into a feeder tube. A motor is configured to supply drive energy to the feeder. Operation of the motor is controlled as a function of the movement of the balls in the feeder tube. A spring element having a storage capacity is configured to store at least some drive energy of the motor. A slip clutch is configured to dissipate drive energy of the motor that exceeds the storage capacity of the spring element.

8 Claims, 4 Drawing Sheets

U.S. PATENT DOCUMENTS

| | | | |
|---|---|---|---|
| 7,021,302 | B2 | 4/2006 | Neumaster |
| 7,040,505 | B2 | 5/2006 | Hashimoto et al. |
| 7,222,617 | B2 | 5/2007 | Andresen |
| 7,234,456 | B2 | 6/2007 | Andresen |
| 7,270,121 | B2 | 9/2007 | Lubben |
| 7,322,348 | B2 | 1/2008 | Chen |
| 7,343,909 | B2 | 3/2008 | Christopher et al. |
| 7,357,129 | B2 | 4/2008 | Neumaster et al. |
| 7,357,130 | B2 | 4/2008 | Broersma |
| 7,428,899 | B2 | 9/2008 | Andresen |
| 7,441,556 | B2 | 10/2008 | Friesen |
| 7,445,002 | B2 | 11/2008 | Christopher et al. |
| 7,568,478 | B2 | 8/2009 | Hedberg |
| 7,654,255 | B2 | 2/2010 | Spicer |
| 7,694,669 | B2 | 4/2010 | Campo |
| 7,770,569 | B2 | 8/2010 | Andresen |
| 2004/0211402 | A1 | 10/2004 | Christopher et al. |
| 2006/0130821 | A1 | 6/2006 | Hamilton |
| 2007/0012303 | A1 | 1/2007 | Christopher et al. |
| 2007/0012304 | A1 | 1/2007 | van Dorsser et al. |
| 2007/0017495 | A1 | 1/2007 | Andresen |
| 2007/0056573 | A1 | 3/2007 | Campo |
| 2007/0062506 | A1 | 3/2007 | Bell |
| 2007/0137631 | A1 | 6/2007 | Christopher |
| 2007/0246479 | A1 | 10/2007 | Andresen |
| 2007/0256676 | A1 | 11/2007 | Orvis et al. |
| 2008/0047537 | A1 | 2/2008 | Kulp et al. |
| 2009/0000608 | A1 | 1/2009 | Christopher et al. |
| 2009/0025700 | A1 | 1/2009 | Andresen |
| 2009/0133680 | A1 | 5/2009 | Christopher et al. |

FOREIGN PATENT DOCUMENTS

| | | |
|---|---|---|
| DE | 3721527 | 1/1989 |
| DE | 4343870 | 6/1994 |
| DE | 4343871 | 10/2000 |
| DE | 19922589 | 12/2000 |
| EP | 0075970 | 4/1983 |
| EP | 01054228 | 11/2000 |
| EP | 01653189 | 5/2006 |
| FR | 921527 | 5/1947 |
| GB | 470201 | 8/1937 |
| GB | 551077 | 2/1943 |
| GB | 2322438 | 8/1998 |
| JP | 1179898 | 7/1989 |
| JP | 6325233 | 11/1994 |
| TW | M255391 | 1/2005 |
| WO | WO 98/13660 | 4/1998 |
| WO | WO 01/44745 | 6/2001 |
| WO | WO 02/42708 | 5/2002 |
| WO | WO 03/087698 | 10/2003 |
| WO | WO 2007/033309 | 3/2007 |
| WO | WO 2007/035601 | 3/2007 |
| WO | WO 2007/044546 | 4/2007 |
| WO | WO 2007/044822 | 4/2007 |
| WO | WO 2007/098554 | 9/2007 |
| WO | WO 2008/104061 | 4/2008 |
| WO | 2009/009748 | 1/2009 |

OTHER PUBLICATIONS

WARPIG—World and Regional Paintball Information Guide, http://www.warpig.com/paintball/technical/loaders/evlution/index.shtml Brass Eagle's eVLuiton Loader, by Bill Mills, Aug. 2000, pp. 1 to 6.

WARPIG—World and Regional Paintball Information Guide, http://www.warpig.com/paintball/technical/labs/revytimes/index/shtml WARPIG Ballistic Labs Report: Revolution Response Times, by Bill Mills, copyright 1992-2010, pp. 1 to 5.

WARPIG—World and Regional Paintball Information Guide http://www.warpig.com/paintball/technical/loaders/halo/index.shtml warpig.com, Odyssey Readies Halo for Production, by Bill Mills, Jun. 2001, pp. 1 to 5.

WARPIG—World and Regional Paintball Information Guide http://www.warpig.com/paintball/technical/loaders/halo/index.shtml warpig.com, Odyssey Halo, by Bill Mills, Dec. 2001, pp. 1 to 7.

Odyssey Halo B Paintball Hopper Review http://www.paintball-gun-review.com/hopper-reviews/adyssey-halo-b... Paintball Gun Review, Odyssey Halo B Paintball Hopper Review, 2004 Paintball-Gun-Review.com, pp. 1 to 4.

www.odysseypaintball.com http://web.archive.org/web/20030205112543/http://www.odysseypaintball... Odysseypaintball Products, Understanding Halo B, pp. 1 to 3.

PROCEDURE AND DEVICE FOR FEEDING BALLS INTO THE PROJECTILE CHAMBER OF A HANDGUN

CROSS REFERENCE TO RELATED APPLICATIONS

This application is a continuation of U.S. patent application Ser. No. 11/841,096, filed Aug. 20, 2007, issuing as U.S. Pat. No. 7,770,569 on Aug. 10, 2010, which is a continuation of U.S. application Ser. No. 11/182,937, filed Jul. 15, 2005, now abandoned, which is a continuation-in-part of U.S. patent application Ser. No. 10/965,384, filed Oct. 14, 2004, now U.S. Pat. No. 7,428,899, issued Sep. 30, 2008, the entire contents of all of which are incorporated by reference as if fully set forth herein.

BACKGROUND

The invention concerns a procedure for feeding balls into the projectile chamber of a handgun, in particular the projectile chamber of a paintball gun. A ball container is connected with the projectile chamber via a feeder tube. The balls are fed from the ball container into the projectile chamber via the feeder tube by means of a motor. The invention further concerns a device designed to carry out the procedure.

A device in which the balls are fed into the projectile chamber in this manner is described in detail, for example, in U.S. patent application Ser. No. 10/965,384 filed Oct. 14, 2004 submitted by the same Applicant, the disclosure of which is incorporated by reference into the present application. It has turned out to be a problem to control the motor in such a way as to allow fast feeding of the balls and to provide the feeding force at the right moment.

SUMMARY

The invention is based on the object of providing a procedure and a device that allow fast and reliable feeding of the balls into the projectile chamber and that avoid unnecessary operation of the motor.

According to the invention, the motor is controlled as a function of the movement of the balls in the feeder tube. In this way it is possible to suitably control the feeding force supplied by the motor as a function of the actual status of the balls in the feeder tube.

Information about the balls is needed in order to perform the control operations as a function of the movement of the balls. In order to obtain the information, the device according to the invention may comprise a sensor to monitor the movement of the balls in the feeder tube and to provide status reports on the presence or absence of balls in the feeder tube. By mounting the sensor on the device itself, and not on the weapon, the device can be operated in conjunction with various weapons.

The sensor may comprise a light barrier arranged on the feeder tube. When there is no ball situated in the light path, the light barrier is not interrupted, but it is interrupted when a ball is situated in that location.

In an advantageous embodiment of the invention the sensor is arranged close to the end of the feeder tube pointing towards the projectile chamber. The balls located in this zone are just about to enter the projectile chamber and direct information can be obtained.

The device may further comprise a spring element for storing the drive energy of the motor. The energy stored in the spring element can be used to feed several balls into the projectile chamber without it being necessary to start up the motor. Drive energy supplied by the motor while the balls are not moving can be stored in the spring element. In order to protect the spring element from becoming overloaded, the spring element may be connected to the motor via a slip clutch. If the motor supplies more energy than can be stored in the spring element, the excess energy can be dissipated via the slip clutch.

The sensor is preferably designed in such a way that it reports the two statuses "ball present" and "no ball present". A change in status occurs when, after a certain period of time during which it has reported one of the statuses, the sensor reports the other status. A resting phase occurs when the row of balls present in the feeder tube is stationary relative to the feeder tube. In the reports generated by the sensor, a resting phase is characterized by the fact that no change in status is reported for a period of time that is longer than the period of time required to feed two successive balls into the projectile chamber during a burst of firing.

A change in status following immediately after a resting phase is referred to as a first change in status. Changes in status following a first change in status, without any intervening resting phase, are referred to as further changes in status.

The motor is preferably switched on for a start-up period following a first change in status. The start-up period lasts for a defined length of time which is adapted to the interplay between the feeder device and the handgun.

After the balls have started to move in the feeder tube, it takes a certain amount of time until the sensor detects the first change in status. This is because the balls are of a certain size and must cover a distance dependent on this size before any change in status occurs from "ball present" to "no ball present", or vice versa. This period is referred to as the first period of ball movement that triggers the first change in status. The start-up period is advantageously longer than the first period of ball movement. The excess operating time of the motor compared with the duration of the movement takes account of the fact that, after it has been idle, a certain amount of time is needed to start the motor up again.

The start-up period is preferably at least twice as long as the first movement period. In particular, the length of the start-up period may be between 60 ms and 100 ms, and preferably between 70 ms and 90 ms.

Depending on how many balls are discharged during a burst of firing, the first change in status may be followed by further changes in status. After each further change in status the motor advantageously continues to operate for a certain period of working time. Unlike in the case of the start-up period, the motor is not set in motion but continues to operate because a working period follows immediately after the start-up period or after a preceding working period. At the start of a working period the motor is thus already operating and no acceleration phase is any longer needed. For this reason, a working period can be shorter than the start-up period. The total period of time for which the motor is operating while a burst is being fired is determined by the total of the start-up period and the working periods.

In order for the sensor to report a further change in status following a previous change in status, the balls must move a certain distance inside the feeder tube. The period of time during which the balls are in motion and trigger a further change in status is referred to as the further period of ball movement. The working periods are preferably longer than the further periods of ball movement. As a result, the motor remains in operation for a longer period of time than the balls are moving in the feeder tube. The period of time during which the motor continues to operate, while the balls, however, are once more at rest, is referred to as the run-on time. During the run-on time the motor can resupply the spring element with the energy which the spring element had discharged in order to set the balls in motion before the first change in status.

The sensor can be arranged in such a way that, during the resting phase, a ball is present in front of the sensor. In this case, the first change in status is a change from "ball present" to "ball not present". The second change is a change from "ball not present" to "ball present". In this case, the sensor is set up in such a way that it reports two changes in status when the balls move by the length of one ball in the feeder tube. When the balls move by the length of one ball in the feeder tube, the operating period of the motor is thus extended by two working periods. The length of these working periods can be between 20 ms and 60 ms, and is preferably between 30 ms and 50 ms. In an alternative embodiment, the sensor can also be set up in such a way that it reports only one change in status per ball. In this case, the working periods chosen should be twice as long.

Depending on what is practical, the sensor can also be arranged in such a way that no ball is present in front of the sensor during the resting phase. The sequence described is then reversed.

The more shots that are fired in a burst, the longer will be the run-on time, because for each individual shot the working period is longer than the movement period. Since the spring element has only a limited capacity for storing the drive energy supplied during the run-on period, the latter period can be limited to a maximum duration. The maximum duration of the run-on time is preferably between 170 ms and 400 ms, and furthermore preferably between 320 ms and 360 ms.

Before the device is put into operation, all the balls are present in the ball container and the feeder tube is empty. In order to get the device ready for use, the feeder tube must be filled with balls. For this purpose, when the device is started up, the motor can be switched on for a preparatory period of time which is preferably sufficiently long for the feeder tube to become completely filled with balls. The preparatory period may have a predetermined duration. Independent of the predetermined duration, or in addition to it, the end of the preparatory period can be determined by the fact that the sensor arranged at the end of the feeder tube reports a change in status, i.e. the presence of a ball.

BRIEF DESCRIPTION OF THE DRAWING(S)

The invention is described in the following, on the basis of an advantageous embodiment and making reference to the attached drawings.

DETAILED DESCRIPTION OF THE PREFERRED EMBODIMENTS

Figure 1:
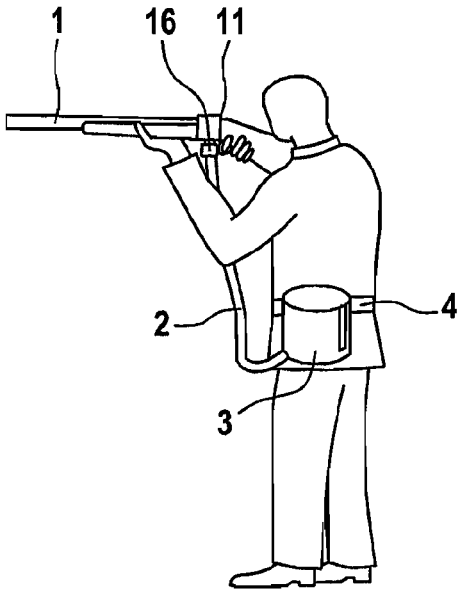
FIG. 1 shows the device which is the subject of the invention being used.

A shooter shown in FIG. 1 is using a weapon 1, for example an air rifle used to fire paintballs, which is connected via a feeder channel, which is designed here in the form of a flexible feeder tube 2, to a ball container 3. The ball container 3 holds balls which are fed by means of a feeder 8 in an unbroken sequence through the feeder tube 2 to the projectile chamber 11 of the gun 1. During this process, a spring force is applied to the balls so that in each case, when a ball has been fired and the empty projectile chamber 11 opens up, a new ball is fed from the feeder tube 2 into the projectile chamber. The ball container 3 is attached to the belt 4 of the shooter. In an alternative embodiment, the ball container may be firmly attached to the weapon via a rigid feeder channel.

Figure 2:
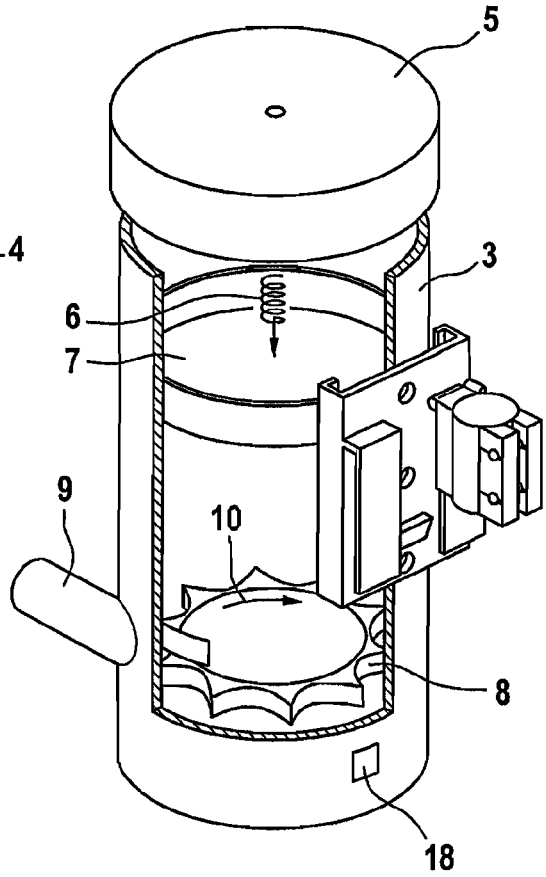
FIG. 2 shows a partially cut-away view of the ball container with the feeder.
Figure 3:
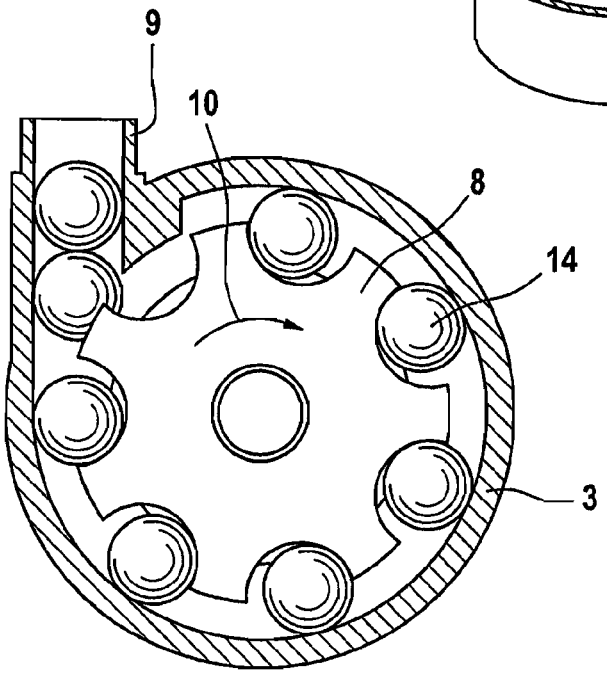
FIG. 3 shows a cross section through the ball container, looking down on the feeder.

As shown in FIG. 2, the ball container 3 is cylindrical in shape and is provided with a lid 5 which is connected via a diagrammatically arranged pressure spring 6 to a pressure plate 7. Under the action of the spring 6 the pressure plate 7 forces the contents of the container away from the open end of the container, which is closed off by the lid 5, and towards the other end of the container. At this other end is located the feeder 8 which transports the balls 14 into the outlet channel 9 of the ball container 3. The outlet channel 9 is attached to the inlet end of the feeder tube 2.

A drive motor M drives a drive shaft 26 on which are arranged, concentrically one on top of the other, a transmission element 19, a distance keeper 28, a spiral spring 27 and the feeder 8. The transmission element 19 is firmly connected with the drive shaft 26; the distance keeper 28, the spring element 27 and the feeder 8 are journaled on the drive shaft 26 in such a way that they can be freely rotated relative to the drive shaft 26. The spiral spring 27, being the spring element storing the energy necessary for feeding the balls, is connected with an inner end 25 with the feeder 8 via a bayonet-like link. At its outer end, the spiral spring 27 has a pin 21 which, being a protrusion, bears on one of the flexible protrusions 20 of the transmission element 19. When the shaft 26 is put in rotation by the motor M, the flexible protrusion 20 of the transmission element 19 transmits this rotation to the pin 21.

The feeder 8 can be caused to rotate in the direction indicated by the arrow 10 by means of the electric motor M arranged in the lower area of the ball container 3. The motor M is connected via the spring element 27 and a slip clutch 27, 28, 19 to the feeder 8. Rotation of the motor drive shaft 26 is transmitted via the spring element 27 to the feeder 8. As soon as the feeder tube 2 is completely filled with balls, the feeder 8 is prevented from rotating any more. If further drive energy is supplied by the motor M while the feeder 8 is stationary, this causes the spring element 27 to become tensioned, so that the spring element 27 stores the drive energy of the motor M. If the spring element 27 is tensioned to the maximum extent, further drive energy supplied by the motor M is dissipated via the slip clutch. The features of this drive mechanism with spring element 27 and slip clutch 27, 28, 19 are described in detail in U.S. application Ser. No. 10/965,384 filed by the same applicant. A control unit 18 which controls the motor M as a function of the reports received from the sensor 16 is arranged in the lower area of the ball container 3.

If shots are fired from the rifle 1, the first balls 14 can be conveyed into the projectile chamber of the weapon 1 by means of the energy stored in the spring element 27. However, because the energy stored in the spring element 27 is sufficient only to convey a few of the balls 14, the motor M must be controlled in such a manner that it provides new drive energy in a timely fashion. The procedure which is the subject of the invention is concerned with controlling the motor M.

A sensor 16 is arranged at the end of the feeder tube 2 adjoining the weapon 1 and is used to determine whether a ball 14 is present in this area of the feeder tube 2. The sensor 16 comprises a light barrier whose light beam runs in the cross-sectional plane of the feeder tube 2. The light beam is interrupted if a ball 14 is present at that location, and it is not interrupted if no ball is present there. The motor M is controlled as a function of the status reports put out by the sensor 16.

Figure 4:
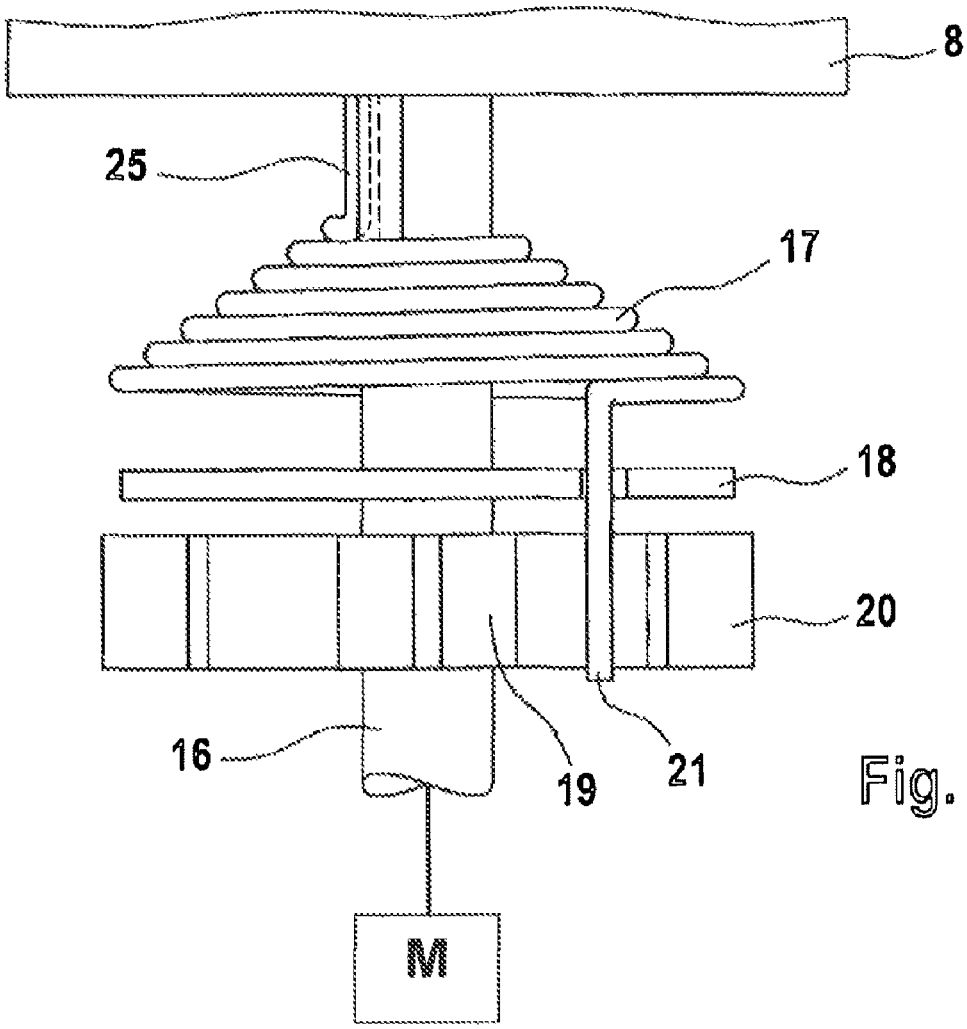
FIG. 4 shows a lateral view of the transmission between the drive motor and the feeder.
Figure 4A:
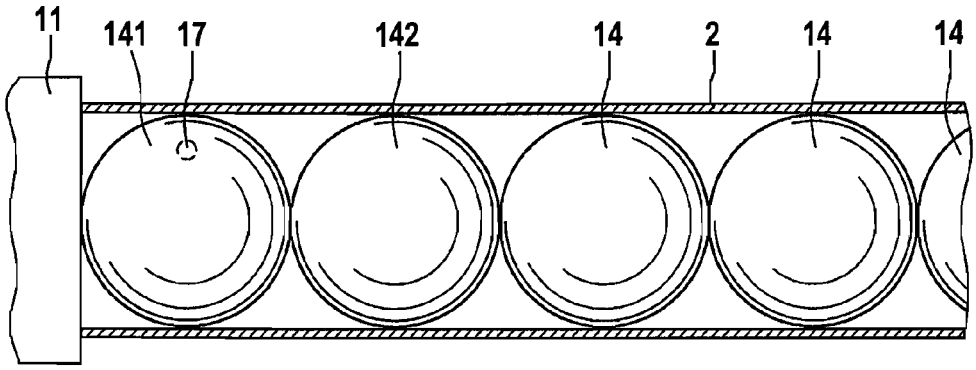
FIGS. 4A-4C show a diagrammatic view of a feeder tube filled with balls in three different configurations.

In FIG. 4, one end of the feeder tube 2 adjoins the inlet to the projectile chamber 11 of the weapon 1. A light barrier 17 in the sensor 16 intersects the feeder tube 2 in a direction perpendicular to the plane of the drawing. During the resting phase depicted in FIG. 4A, the feeder tube 2 is completely filled with balls 14, and the frontmost ball 141 is situated at the entrance to the projectile chamber 11 of the weapon 1. The entrance to the projectile chamber 11 is closed, and all the balls are at rest within the feeder tube 2. The series of balls 14 contained in the feeder tube 2 is acted on by the spring force transmitted via the feeder 8. The light barrier 17 is interrupted by the ball 141 and the sensor 16 reports the presence of a ball.

Figure 4B:
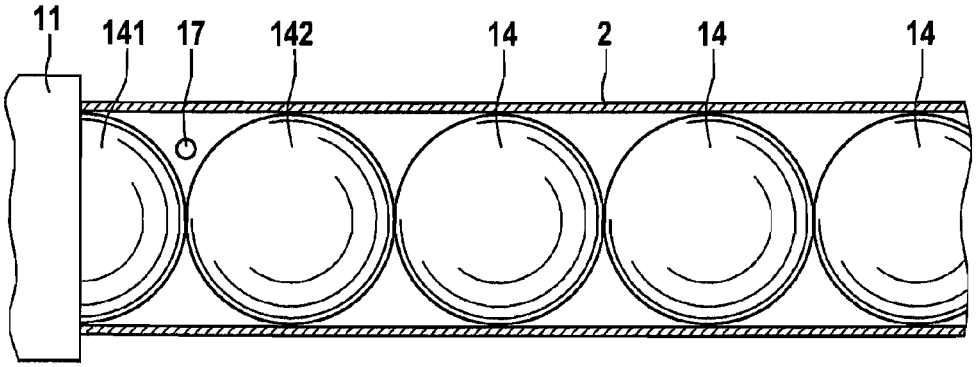
Figure 4C:
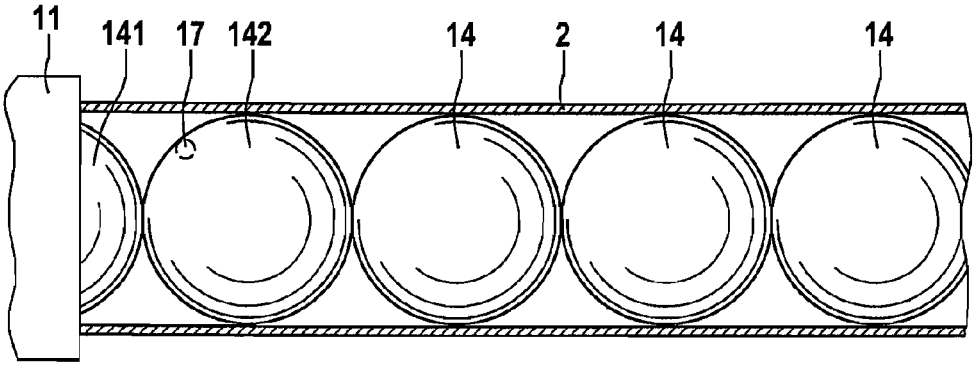

After a shot is fired by the weapon 1, the inlet to the projectile chamber 1 opens up, and the frontmost ball 141, driven by the force of the spring, moves into the projectile chamber 11. Once the ball 141 has partially entered the projectile chamber 11, in the status as depicted in FIG. 4B, the light barrier 17 detects a first change in status, namely that there is no longer a ball present in the area of the light barrier 17. As the ball 141 continues to move into the projectile chamber 11, the next ball 142 enters into the area of the light barrier 17, interrupting the latter as shown in FIG. 4C. The sensor 16 reports a further change in status.

Figure 5A:
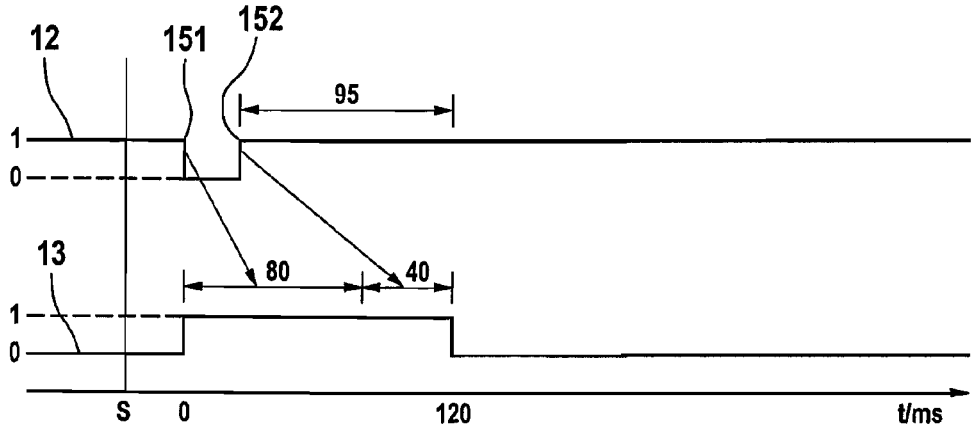
FIG. 5 shows the temporal sequence of reports from the sensor and of the operation of the motor for three different bursts of fire.
Figure 5B:
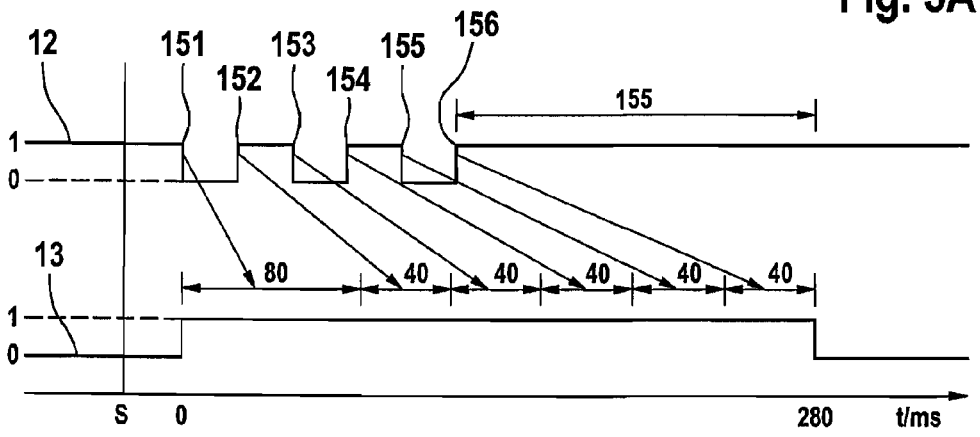
Figure 5C:
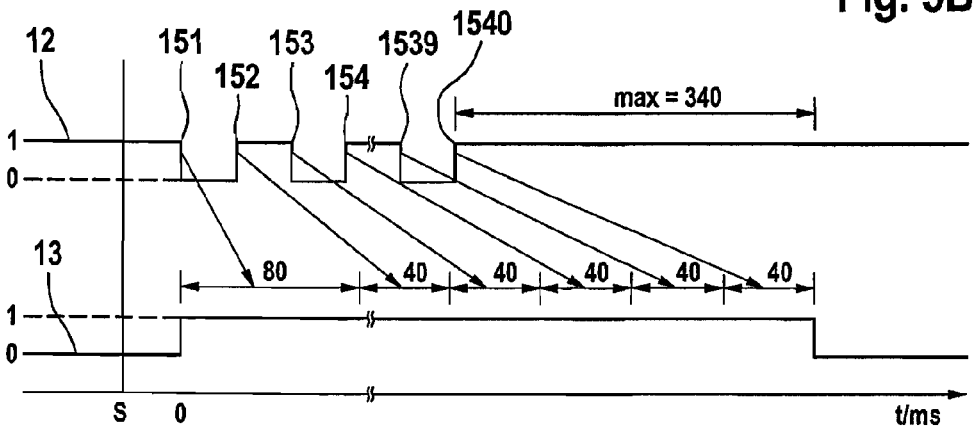

The control of the motor M as a function of the changes in status reported by the sensor 16 is depicted in diagrammatic form in FIG. 5. FIG. 5A shows the sequence occurring when a single shot is fired; FIG. 5*b* shows the sequence occurring when three shots are fired in a burst; and FIG. 5C shows the sequence occurring when twenty shots are fired in a burst. In each case, in FIGS. 5A, 5B, 5C, the status of the sensor 16 is shown above the time axis in Diagram 12 and the status of the motor M is shown above the time axis in Diagram 13. Both the sensor and the motor M alternate only between the states 0 and 1. In state 1 a ball is present in front of the sensor, and in state 0 no ball is present in front of the sensor. In state 0 the motor M is stationary and in state 1 it is in operation. All the numerical data shown in FIG. 5 indicate time in ms.

FIG. 5A shows the temporal sequence when a single shot is fired from the weapon 1. The point in time S designates the starting point at which, following the firing of the shot, the entrance to the projectile chamber 11 opens up and the ball 141 starts to move into the projectile chamber 11. As soon as the status shown in FIG. 4B is reached, the sensor reports at time 151 that the first change in status has occurred following a resting phase. The first change in status at time 151 is reported to the control unit 18 which thereupon causes the motor M to start operating for a start-up time of 80 ms. As the ball 141 penetrates further into the projectile chamber 11, the status shown in FIG. 4C is reached, where the ball 142 enters the zone of the light barrier 17. At time 152 the sensor reports a further change in status. The control unit 18 causes the motor M to continue operating after the further change in status at time 152 for a working period of 40 ms duration immediately following the start-up period. Since the sensor 16 no longer reports any further changes in status after time 152, the motor M is switched off after the first working period.

A period of time which triggers the first change in status elapses between the point in time S, when the movement of the balls 14 in the feeder tube 2 commences, and the time 151, when the balls 14 are located in position 4B. It is assumed here that the length of this period of time is 25 ms. Once the first change in status has occurred, the motor M is set in operation for a start-up time of 80 ms. The start-up time is more than twice as long as the movement period that triggers the first change in status. This takes account of the fact that it requires a certain amount of time to set the motor M in motion.

The period of time between the first change in status 151 and the further change in status 152 corresponds to the time required by the balls 14 in the feeder tube 2 to move from status 4B to status 4C. The length of this period of movement by the balls 14, which triggers the further change in status 152, is also assumed to be 25 ms. The working period associated with the movement period 151 to 152 is at 40 ms longer than the movement period. This difference between the working period and the movement period results in a run-on time during which, on the one hand, the balls are returned from status 4C to the position shown in 4A, and the spring element 27 is tensioned.

The overall operating duration of the motor M when a shot is fired is made up of the start-up time of 80 ms and a working period of between 40 ms and 120 ms. After the last reported change in status at time 152, the motor M continues to run for a further 95 ms.

FIG. 5B shows the temporal sequence 12 of the changes in status reported by the sensor 16 and the temporal sequence 13 of the operation of the motor M for the case in which a burst of three shots is fired. Exactly as in the case when a single shot is fired, the sensor 16 reports the first change in status at time 151 and a further change in status at time 152. After the first change in status 151 the motor M is set in motion for a start-up period of 80 ms; after the further change in status 152, the motor M continues to operate for a working period of 40 ms. Following the changes in status 153 to 156, the motor M continues to run in each case for a further working period of 40 ms, with each successive working period following immediately after a preceding working period. The overall operating time of the motor M when a burst of three shots is fired is made up of the start-up time of 80 ms and the five working periods, each of 40 ms, for a total of 280 ms. Following the last reported change in status 156 the motor M runs on for 155 ms. The run-on time is sufficient to bring the balls 14 back to the resting phase 4A and to fully tension the spring element 27.

When a burst of twenty shots is fired, as shown in FIG. 5*c*, the sensor 16 reports a first change in status 151 followed by 39 further changes in status 152 to 1540. After the first change in status 151, the motor M is set in motion for a start-up time of 80 ms. For each of the further changes in status 152 to 1540, the motor M continues to run for working periods of 40 ms. The movement periods of the balls 14 which trigger the changes in status 151 to 1540 add up to an overall duration of 975 ms. The total amount of time made up of the start-up period of 80 ms and 39 working periods each of 40 ms is 1640 ms, which would give a calculated run-on time of 665 ms. However, the operating duration of the motor M required to convey the balls 14 back to the starting status 4A and to fully tension the spring element 27 is substantially shorter than 665 ms. For this reason, the run-on duration is limited to a maximum length of 340 ms. If the calculated run-on time, as the difference arising from the sum of the start-up period and the working periods as well as the movement periods, adds up to more than 340 ms, this excess portion of the run-on time is ignored. The run-on time remains fixed at 340 ms regardless of how many further changes in status the sensor 16 reports.

At the time of start-up the ball container 3 is filled with balls 14 and there are no balls in the feeder tube 2. In order to fill the feeder tube 2 with balls, the motor M is switched on for an adequately long period of time. As soon as the sensor 16 at the end of the feeder tube 2 close to the projectile chamber 11 reports the presence of a ball 14, this means that the feeder tube 2 is filled with balls. After receiving the report from the sensor 16, the control unit 18 allows the motor M to continue running for a short period of time to ensure that the spring element 27 is fully tensioned. This completes the preparatory period and the weapon 1 is ready to be used.

What is claimed is:

1. A device for storing projectile balls and feeding the balls into a projectile chamber of a gun, comprising:

a ball container;

a feeder positioned within the ball container for feeding balls into a feeder tube;

a motor configured to supply drive energy to the feeder, wherein operation of the motor is controlled as a function of the movement of balls in the feeder tube;

a spring element having a storage capacity and configured to store at least some drive energy of the motor; and, a slip clutch in communication with the feeder and configured to dissipate drive energy of the motor that exceeds the storage capacity of the spring element.

2. The device according to claim 1, further comprising a system for intermittently switching on the motor.

3. The device according to claim 1, further comprising a sensor for detecting a projectile in the feeder tube.

4. The device according to claim 3, further comprising a control unit in communication with the sensor.

5. A procedure for feeding projectile balls to the projectile chamber of a paintball gun, whereby projectile balls are fed by means of a motor from a ball container through a feeder tube into a projectile chamber of a paintball gun, the motor is controlled as a function of the movement of projectile balls in the feeder tube, drive energy supplied by the motor may be stored in a spring element having a storage capacity, and whereby the drive energy that exceeds the storage capacity of the spring element is dissipated via a slip clutch.

6. The procedure according to claim 5, further comprising a system for intermittently switching on the motor.

7. The procedure according to claim 5, further comprising a sensor for detecting a projectile in the feeder tube.

8. The procedure according to claim 7, further comprising a control unit in communication with the sensor.

* * * * *